United States Patent [19]

Ausnit

[11] 3,959,856

[45] June 1, 1976

[54] INTERLOCKING SEPARABLE FASTENER

[76] Inventor: Steven Ausnit, 124 E. 61st St., New York, N.Y. 10021

[22] Filed: Mar. 6, 1975

[21] Appl. No.: 555,881

[52] U.S. Cl. ..... 24/201 C

[51] Int. Cl.[2] ..... A44B 19/14; A44B 17/00

[58] Field of Search ..... 24/201 C

[56] References Cited

UNITED STATES PATENTS

| | | | |
|---|---|---|---|
| 1,706,097 | 3/1929 | Aud | 24/201 C |
| 2,780,261 | 2/1957 | Svec | 24/201 C |
| 2,789,609 | 4/1957 | Post | 24/201 C |
| 3,054,434 | 9/1962 | Ausnit | 24/201 C |
| 3,173,184 | 3/1965 | Ausnit | 24/201 C |
| 3,220,076 | 11/1965 | Ausnit | 24/201 C |
| 3,696,472 | 10/1972 | Perina | 24/201 C |
| 3,846,575 | 11/1974 | Troy | 24/201 C |

FOREIGN PATENTS OR APPLICATIONS

| | | | |
|---|---|---|---|
| 497,015 | 8/1954 | Italy | 24/201 C |

*Primary Examiner*—Bernard A. Gelak
*Attorney, Agent, or Firm*—Hill, Gross, Simpson, Van Santen, Steadman, Chiara & Simpson

[57] ABSTRACT

A separable fastener especially suitable for heavy duty sheet-like enclosures comprises complementary, resilient hooked rib and groove closure strips having angular hinged flange connections for attachment to generally coplanar enclosure sheet margins capable of acting as expansion joints permitting a range of pulling apart of said margins without disturbing the interlocking relationship of the ribs and grooves of the fastener strips. A simple U-shaped slider can be employed to effect closing only of the fastener, and a pull flange is provided for opening of the fastener when desired, but only with a degree of difficulty.

2 Claims, 3 Drawing Figures

Fig-1
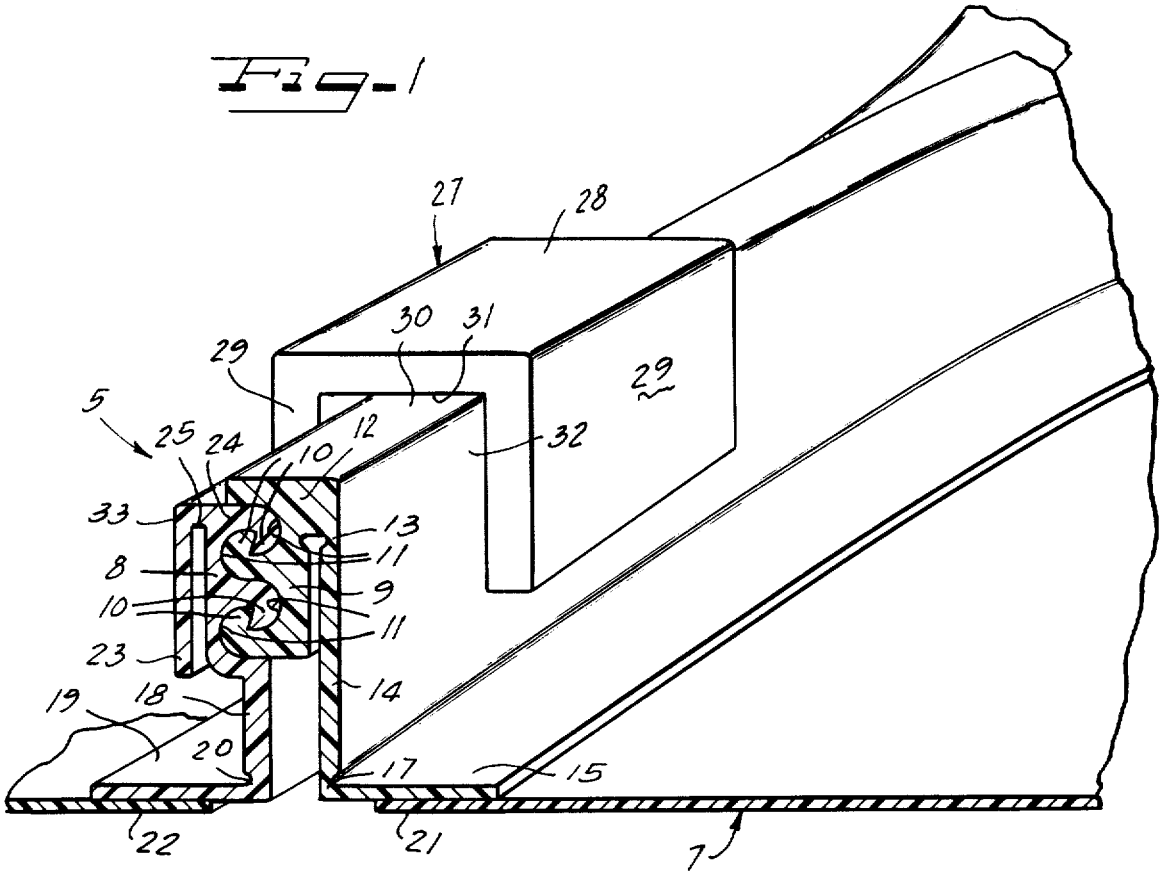
Fig-3
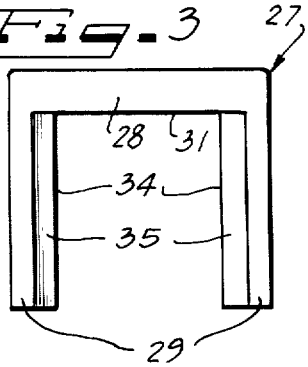
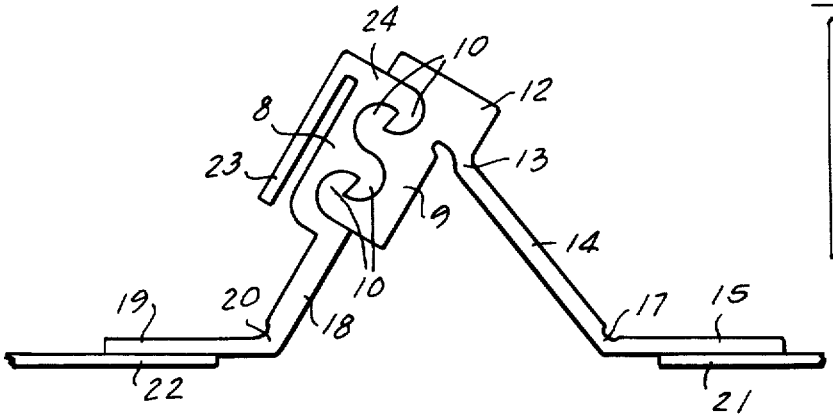
Fig-2

INTERLOCKING SEPARABLE FASTENER

This invention relates to a new and improved separable fastener structure especially suitable for heavy duty sheet material enclosures such as may comprise cocoons employed for protectively enclosing heavy equipment for storage or during shipment.

One of the problems with employing separable resilient fasteners under conditions where the joint closed by the fastener must be capable of withstanding expansion stresses is that the interlocking ribs and grooves of the fastener may be accidentally pulled apart. On the other hand, where the fastener elements are provided with adequate mass and resilient stiffness for heavy duty purposes, a problem has been encountered in effecting separation of the fasteners when necessary. In addition, because of bulk and stiffness, such fasteners may be difficult to close manually, and conventional sliders may not be feasible or desirable.

Accordingly, it is a principal object of the present invention to provide a new and improved interlocking separable fastener construction especially suitable for heavy duty sheet-like wrappers and which will satisfactorily solve the foregoing and other problems.

Another object of the invention is to provide a new and improved separable fastener which is especially useful for securing protective cocoon type closures for sealing equipment for storage or shipment.

A further object of the invention is to provide a new and improved separable fastener having expansion joint capability.

Still another object of the invention is to provide a new and improved separable fastener which is easy to close on an enclosure in which the margins of the sheet or sheets of the enclosure at a joint to be closed by the fastener lie in a generally common plane.

Yet another object of the invention is to provide improved means for effecting closing of a separable fastener.

A yet further object of the invention is to provide new and improved means to facilitate opening of a separable fastener, and which will allow the fastener to be opened without a slider but with substantial resistance to separation, that is, only with a degree of difficulty.

According to the general features of the invention there is provided a separable fastener especially suitable for heavy duty sheet-like enclosures of sheet-like material and comprising a pair of complementary resilient closure strips having separable interlocking longitudinal rib and groove formations, and angular hinging flanges for connecting the strips with generally coplanar oppositely extending margins of sheet-like closure material, the fastener normally acting to retain the margins adjacent to one another and the hinging flanges affording expansion joint capability for the fastener permitting a range of pulling apart of the closure margins without interferring with the interlocking coaction of the ribs and grooves of the fastener.

According to other features of the invention special means are provided to allow opening the closure when necessary, and comprising a manually engageable pull flange structure.

It is also a feature of the invention to provide the fastener with a desirable structure permitting the use of a simple U-shaped slider for closing only and which can be completely removed from the fastener, the fastener being for this purpose constructed to stand out from the generally coplanar margins of the wrapper with which associated and having smooth parallel sides of substantial width for engagement by walls of the slider.

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which:

FIG. 1 is a sectional isometric view showing a fastener according to the present invention to the closure margins of an enclosure made from sheet material and demonstrating how the fastener can be closed by means of a simple U-shaped slider;

FIG. 2 is a schematic illustration of the expansion joint capability of the fastener; and FIG. 3 is an end elevational view of the slider.

Having reference to the drawing, a separable fastener 5 especially suitable for closing a heavy duty enclosure made from sheet-like material 7 is depicted. The fastener 5 comprises a pair of complementary resilient closure strips 8 and 9 having separable interlocking formations in the form of longitudinal, complementary ribs 10 and grooves 11. In a preferred arrangement, the fastener strips 8 and 9 are on the order of those disclosed in U.S, Pat. No. 3,054,434, but with a substantial number of improved features especially equipping the fastener 5 for heavy duty purposes.

Among other features adapting the fastener 5 for heavy duty use, the body of the fastener strip 9 is of substantial mass and provided with a fairly massive head portion 12 which is connected integrally in one piece at a hinge joint 13 to an angular hinging flange formation comprising a riser flange 14 and an angular foot flange 15 connected integrally thereto at a hinge joint 17. Extending integrally from the fastener strip 8 is an angular hinging flange formation comprising a riser flange 18 generally parallel to the riser flange 14 and connected to an integral laterally angularly extending foot flange 19 along a hinge joint 20. In the preferred arrangement shown, the foot flanges 15 and 19 project in respectively opposite directions and lie in substantially a common plane from which the riser flanges 14 and 18 extend to support the fastener strips 8 and 9 in a manner to project the strips a substantial distance from the plane of the foot flanges 15 and 19.

Attachment of the fastener 5 to the wrapper 7 is by permanently securing the foot flanges 15 and 19 to respective coplanar margins 21 and 22 of the enclosure where they approach one another at an openable closure joint which is closed by the fastener 5.

Any suitable plastic material of suitable stiffness but resilience for the intended purpose may be employed in fabricating the fastener 5, and thereby the fastener strips 8 and 9 and the integral flange structures thereof all may be formed by extrusion techniques. Any suitable means may be employed to secure the foot flanges 15 and 19 to the margins 21 and 22, respectively. For example, where the material of the enclosure 7 is of a compatible plastic, so-called electronic welding of the flanges and margins into a unitary heat-sealed relation may be effected.

Means are provided to facilitate separation of the closure strips 8 and 9 from the coupled closed condition. For this purpose, a digitally manipulatable pull flange 23 is formed as an integral extension from a head portion 24 of the closure strip 8, similarly as disclosed in U.S. Pat. No. 2,780,261 but with some important differences. In the present instance, the flange 23 is connected to the head portion 24 by means of a spacer and connecting web 25. From the web 25, the flange 23 extends down toward the foot flange 19 in narrowly spaced relation to the body of the strip 8 and preferably is of about the same width as the body of the strip 8 but substantially thinner and therefore of greater flexibility so that the flange 23 can be readily grasped and flexed downwardly away from the body of the strip 8 to apply a separating force to the strip 8 away from the companion strip 9 held during the separating maneuver by the riser 14 against the separating pull applied to the strip 8 through the flange 23. The purpose of the described arrangement is to permit separation of the fastener strips only with a certain degree of difficulty that is, resistance to separation, rather than with ease as in all prior arrangements.

In order to permit the material of the fastener 5 to be of adequate stiffness for heavy duty usage such as for apparatus-enclosing cocoons, and yet provide for use of slider means to assist in closing the fastener 5, the fastener strips 8 and 9 and their associated flange structures are so constructed and arranged as to permit a simple generally U-shaped slider 27 to be used for the purpose and eliminating any need for any slider partition means on the slider. This also allows for a watertight closure the full length of the zipper. In this instance, the slider may be simply a rugged metal or rigid plastic member having a flat head flange 28 and opposite parallel coextensive side leg flanges 29, with the space between the leg flanges 29 approximately equal to the width of the closed fastener 5, and the inside length of the leg flanges 29 equal to about the vertical dimension of the coupled bodies of the closure strips 8 and 9.

To facilitate engagement with the slider 27, the crown surface of the head portion 12 provides a flat face 30 spaced above the head portion 24 and with which the inside flat face 31 of the slider head flange 28 is engageable for guiding the slider along the closure. At its outer side, the head portion 12 of the strip 9 has a flat surface 32 with which the outer face of the riser flange 14 is desirably coplanar, and the outer side of the flange 23 and the head portion 24, and more particularly the connecting web 25 of the strip 8 comprises a flat surface 33. The surfaces 32 and 33 are engageable by inside flat surfaces 34 on the slider legs 29 to press the fastener strips 8 and 9 together into coupled relation wherein the hooks 10 interengage with one another within the grooves 11. To facilitate movement of the slider 27 along the fastener while effecting coupling of the fastener strips, the fastener legs 29 at least along one end of the fastener are desirably provided with cam chamfer edges 35 leading into the leg surfaces 34. The chamfer can edges 35 also facilitate starting the closure action at one end of the closure 5 by manipulating the slide into position to start the coupling action and then pushing the slide fully into riding position on the upstanding fastener 5 and pushing it slidably longitudinally along the fastener to complete closing of the fastener. On reaching the opposite end of the fastener, if there is an obstruction to the sliding of the slider 27 off of the closed fastener, the slider can be simply removed by lifting it off of the fastener since there is no tongue or retaining partition flange that must be removed from between the fastener strips. It will be appreciated that during the fastener closing action of the slider 27, the slider legs 29 apply sufficient compressive thrust on the fastener strips 8 and 9 toward one another to assure complete interlocking of the ribs 10 of the fastener strips.

Where the fastener 5 is employed as a closure for a container or enclosure for apparatus such as vehicles, including airplanes, tanks, trucks, automobiles, and the like, the enclosure of sheet-like material may be either in the form of a wrapper or a cocoon onto or into which the apparatus is moved as by driving vehicular apparatus onto the wrapper or into a cocoon, whereafter the enclosure is closed about the apparatus by closing the fastener 5 to provide a dirt and moisture proof seal. By virtue of the riser flanges 14 and 18 and their hinged connections, substantial tolerance in the drawing up of the margins 21 and 22 of the enclosure sheet or sheets is attained, with the inherent stiffness of the fastener structure acting to maintain the enclosure margins drawn up toward one another with at least minimal tension. Further, by reason of the hinged connections, the riser flanges 14 and 18 and their foot flanges 15 and 19 provide for a substantial range of expansion movement in the enclosure 7 without disturbing the coupled, sealing relationship of the fastener strips 8 and 9. This expansion capability is demonstrated in FIG. 2. It will be observed that the riser flange 18 is adapted to pivot relative to the foot flange 19 about the hinge juncture 20. The riser flange 14 is adapted to pivot about the hinge juncture 17 relative to the foot flange 15 and about the hinge juncture 13 relative to the fastener strip head 12. Therefore, there is no separating pull applied to the fastener strips 8 and 9 up to a certain degree of expansion movement within the joint closed by the fastener 5. Further, such expansion can progress to the degree that the fastener strips 8 and 9 are moved into substantially the plane of the foot flanges 15 and 19, before any pull on the fastener strips takes place. Due to the inherent resiliency of the material of the fastener 5, there will at all times be yieldable resistance to expansion movement, and by reason of the spring back capability of the angular flange structure of the fastener, there is a continuous drawing up tension provided by the fastener. However, when it is desired to open the fastener 5, manipulation of the pull flange 23 will readily effect opening separation of the fastener strips.

It will be understood that variations and modifications may be effected without departing from the spirit and scope of the novel concepts of this invention.

I claim as my invention:

1. A separable fastener especially suitable for heavy duty enclosures of sheet-like material, comprising:

a pair of resilient fastener strips of substantial width vertically having a plurality of parallel separably interlocking longitudinal complementary rib and groove formations;

one of said fastener strips having a substantially flat head portion forming a crown face;

a riser flange extending downwardly from a resilient hinged joint with the head portion of said one strip and such riser flange being otherwise free from and movable toward and away from said one closure strip and projecting to a substantial distance downwardly from said one strip;

a riser flange extending downwardly from the lower edge of said other of said closure strips;

each of said riser flanges having on its lower edge a respective foot flange resiliently hingedly connected thereto and the foot flanges extending in opposite directions for attachment to margins of a sheet-like enclosure toward one another whereby the interlocked fastener strips will normally act to retain the sheet margins adjacent to one another and the hinged connections will permit a range of pulling apart of the enclosure margins without interfering with the interlocking coaction of the rib and groove formations;

a pull flange for disengaging the fastener strips connected to the head portion of said other fastener strip and extending freely downwardly therealong; and said riser flange extending from said head portion of said one strip and said pull flange providing parallel slider surfaces substantially normal to said flat head portion, whereby to accommodate a U-shaped slider having a flat surfaced body portion engageable with said head portion and downwardly extending flange legs engageable with said flat surfaces.

2. A separable fastener according to claim 1, having in combination therewith a fastener closing slider comprising a body flange portion with a flat surface for engaging slidably with said crown face and spaced downwardly extending flange legs having lower edges substantially spaced from said foot flanges, said slider legs having inner surfaces engaging said parallel flat surfaces for thrusting the fastener strips compressively together to effect interlocking coupling of said rib and groove formations, said slider being adapted to be applied to the fastener by moving the slider into position toward said crown face and into straddling relation to the fastener and being removable from the fastener by lifting it upwardly away from the fastener.

* * * * *